United States Patent [19]

Sieffert

[11] 4,391,371

[45] Jul. 5, 1983

[54] FIBERBOARD SHIPPING CONTAINER HAVING LAMINATED SPACING MEMBERS

[75] Inventor: William G. Sieffert, Joliet, Ill.

[73] Assignee: Champion International Corporation, Stamford, Conn.

[21] Appl. No.: 377,695

[22] Filed: May 13, 1982

[51] Int. Cl.[3] ..... B65D 85/42

[52] U.S. Cl. ..... 206/597; 206/600; 206/419; 206/489; 229/41 C; 229/41 D

[58] Field of Search ..... 206/419, 588–590, 206/600, 489, 490, 488; 229/41 C, 41 D

[56] References Cited

U.S. PATENT DOCUMENTS

| | | | |
|---|---|---|---|
| 1,925,298 | 9/1933 | Boeye | 206/591 |
| 2,807,402 | 9/1957 | Nelbach | 206/589 |
| 3,709,325 | 1/1973 | Gordon et al. | 206/589 |
| 4,042,107 | 8/1977 | Kendig | 206/597 |
| 4,105,153 | 8/1978 | Locke | 229/41 C |
| 4,225,078 | 9/1980 | Croley | 229/41 C |

FOREIGN PATENT DOCUMENTS

| | | | |
|---|---|---|---|
| WO81/00091 | 1/1981 | PCT Int'l Appl. | 206/597 |
| 1216494 | 11/1959 | France | 206/485 |
| 685567 | 9/1979 | U.S.S.R. | 206/589 |

*Primary Examiner*—Joseph Man-Fu Moy
*Attorney, Agent, or Firm*—Evelyn M. Sommer

[57] ABSTRACT

A fiberboard container for the shipment of fragile and irregularly shaped articles includes a top tray, a bottom tray and, in some cases, a protective sleeve between the trays. Each of the trays has cavities to hold the articles, the cavities being formed in a pad of the tray. Each of the trays is constructed with a top pad and a bottom pad, which pads may be of laminated paperboard panels, and spacers of laminated fiberboard, to separate the top pad from the bottom pad.

6 Claims, 3 Drawing Figures

FIBERBOARD SHIPPING CONTAINER HAVING LAMINATED SPACING MEMBERS

BACKGROUND OF THE INVENTION

The present invention relates to packaging and more particularly to a fiberboard container to package articles such as large irregularly shaped and fragile articles.

At the present time it is relatively difficult and costly to package large and fragile articles so that they may be shipped without being damaged. When such articles are shipped, they may be subject to shocks, for example, due to freight car movements, or the packages may be roughly handled by material handling of equipment.

Large, fragile and irregularly shaped objects such as glass vases, television tubes and other glassware may be packaged utilizing a rigid plastic foam, such as molded expanded polystyrene, in which the cavities in the foam are of the same size and shape as the articles to be packaged. The foam, with its encompassed articles, is then positioned in an outer fiberboard casing such as a box of corrugated paperboard. This type of packaging, although it provides good protection to the articles, is relatively expensive, particularly for large articles. Alternative packaging methods use a box and material which is placed in the box and around the article to cushion the article. For example, the cushioning material may be plastic foam bubbles, wood shavings, newspapers, corrugated paper, plastic sheets having air bubbles, or other types of cushioning material. The use of such cushioning material is relatively labor intensive and the degree of protection depends upon the care and experience of the workers performing the packaging operation.

OBJECTIVES AND FEATURES OF THE INVENTION

It is an objective of the present invention to provide a package for the storage and shipment of relatively large and fragile articles which may be made of fiberboard material, such as corrugated paperboard, utilizing conventional machinery and manufacturing techniques.

It is a further objective of the present invention to provide such a package in which the articles may be placed in built-in cavities and securely held by the walls of the cavities.

It is a further objective of the present invention to provide such a package which will be relatively low in cost compared to certain of the alternative packaging methods providing the same degree of security against shock during shipment.

It is a feature of the present invention to provide a package for enclosing and protecting a plurality of articles. For example, the articles may be large glass objects such as television tubes. The package includes a bottom tray and a top tray and may include a protective sleeve which separates the two trays.

Each of the trays includes a bottom pad including one or a plurality of fiberboard panels, for example, two or three rectangular corrugated cardboard panels which may be laminated to form the pad. A top pad includes one or more fiberboard panels. Each top had has a series of shaped openings, forming cavities, corresponding to the shapes of the articles being held by the package.

Each tray also includes a plurality of opposite wall spacers and a plurality of internal spacers. Each of the spacers is a block comprised of laminated fiberboard. The wall spacers and the internal spacers are of the same height. They are glued to the top and bottom pads to separate the pads and stiffen the structure of the trays.

It is a further feature of the invention that the sleeve of fiberboard, which separates the bottom and top trays and encloses the packaged articles, has eight flat panel sides connected by fold lines.

BRIEF DESCRIPTION OF THE DRAWINGS

Other objectives and features of the present invention will be apparent from the detailed description which provides the inventor's presently known best mode of practicing the invention. The detailed description should be taken in conjunction with the accompanying drawings, in which.

DETAILED DESCRIPTION OF THE INVENTION

The complete package is made of fiberboard and comprises a bottom tray, a top tray and a protective sleeve which separates the bottom tray from the top tray. The sleeve is not needed in those packages in which the two trays meet in a face-to-face relationship. The package (tray pack) is a shipping container which, by holding each article in its own cavity, separates the articles and protects them during shipment.

Figure 1:
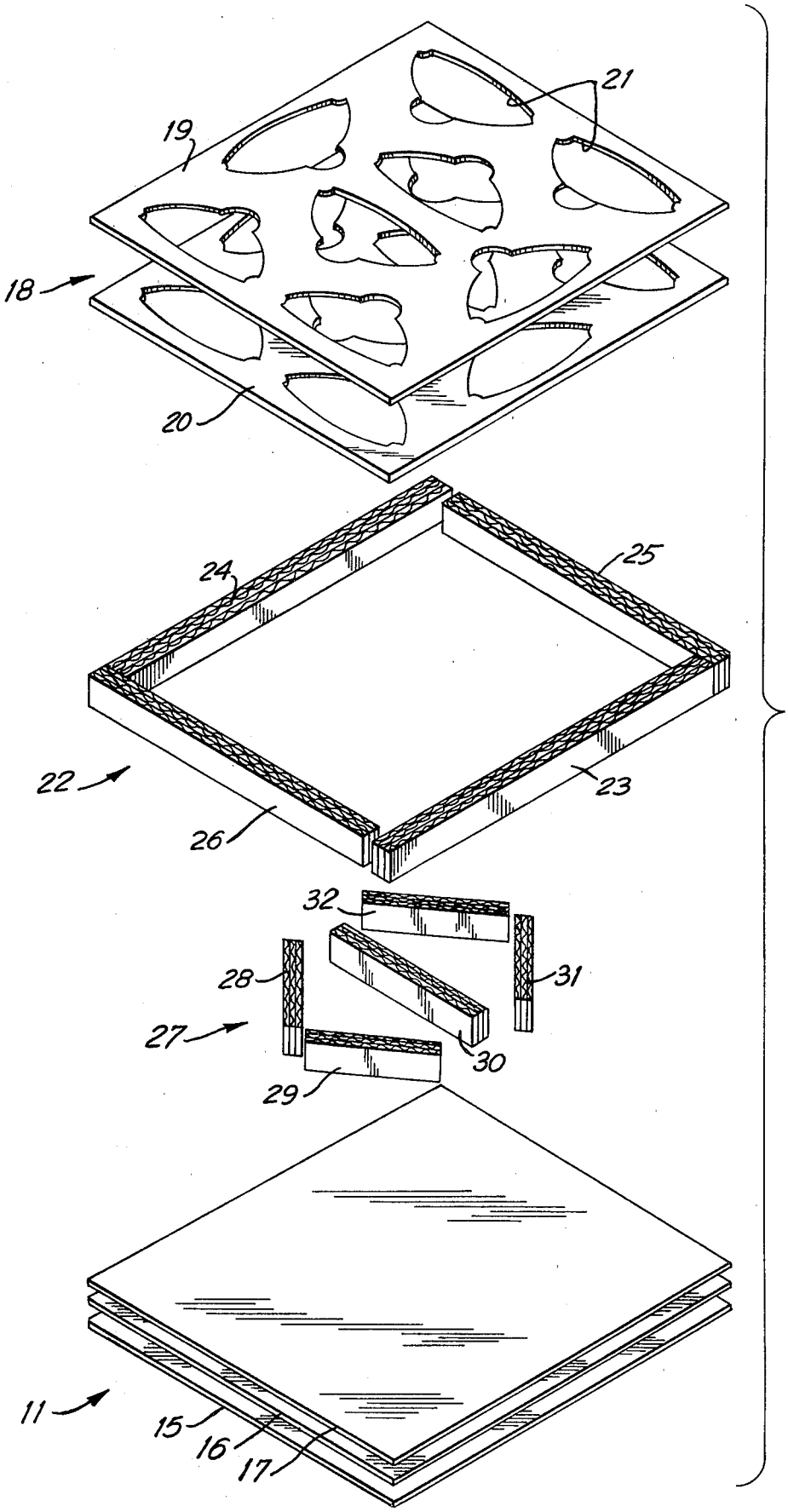
FIG. 1 is a perspective and expanded view showing the parts comprising a bottom tray of the package of the present invention.

The construction of the bottom tray 10 is illustrated in FIG. 1. The top tray 30 is of the same construction as the bottom tray, except that its openings may be the same or the mirror image of the openings in the bottom tray.

The terms "fiberboard" and "fiberboard material" includes corrugated or uncorrugated paperboard and other forms of panels made from fiber materials. For example, each of the panels may be of single, double or triple corrugated cardboard, a type of fiberboard. In single corrugated cardboard a corrugated layer of paperboard is sandwiched between, and glued to, top and bottom layers of paperboard.

As shown in FIG. 1, the bottom tray includes a bottom pad 11 consisting of one, or a plurality, of flat fiberboard panels. As shown in FIG. 1, the bottom pad 11 comprises a bottom panel 15, a central panel 16 and an upper panel 17. The three panels 15–17 are adhesively laminated on the respective facing flat faces to form the single laminated bottom pad 11. Each of the panels 15–17 is rectangular in shape and preferably, but not necessarily, of the same size and shape as the other panels to which it is laminated.

The top pad 18 may also consist of one or more thicknesses of panels. As illustrated in FIG. 1, the top pad 18 consists of an upper panel 19 and a lower panel 20 which are adhesively laminated to form a pad having a double thickness. Each of the panels 19 and 20 has a plurality of openings 21 which may be die-cut. The openings 21 are aligned when the faces of the panels 19 and 20 are adhered to form the laminated pad 18. The openings 21 are preferably in the shape of the article to be held by the package. As illustrated in FIG. 1, the openings 21 are designed to hold television tubes, although it will be understood that other sizes and shapes of openings may be utilized depending upon the sizes and shapes of the articles to be packaged.

A series of wall spacers 22 are used to separate the top pad 18 from the bottom pad 11 and form a gap between them. The wall spacers 22 comprise the front wall spacer 23, the rear wall spacer 24 and opposite wall spacers 25 and 26. Each of the wall spacers 22 is preferably formed from a laminated pile of corrugated fiberboard. The wall spacers form a rectangular configuration whose outer walls are aligned with the borders of the rectangular top pad 10 and bottom pad 18. The height of the spacers depends upon the desired spacing between the top pad 18 and the bottom pad 11 which, in turn, depend upon the size and shape of the articles to be packaged.

A set of interior spacers 27 are also utilized along with the wall spacers to separate the top pad 18 from the bottom pad 11 and to provide rigidity to the tray. As illustrated in FIG. 1, there are five interior spacers 28 through 32. Each of the interior spacers is preferably formed from a laminated pile corrugated cardboard. These interior spacers 28–32 are strategically located between the top pad 18 and the bottom pad 11 so as to prevent collapse of the top pad when the articles are inserted through the openings 21. The wall spacers and the interior spacers at the bottom faces are adhered to the bottom pad 18 and they are adhered, at their top faces, to the top pad 10.

The illustration of the openings 21 in FIG. 1 shows each of the openings 21 being of the same size and shape. This sameness of size and shape for the openings 21 would be utilized when the goods being packaged are of the same size and shape. Alternatively, and not shown, the openings 21 may be each of different sizes and shapes or they may be a plurality of different sizes and shapes, or alternatively a second plurality of the same sizes and shapes, depending upon the size and shape of the goods to be packaged. The alignment of an opening in the top pad with an opening in the bottom pad forms, in effect, a plurality of cavities each of which holds an individual packaged article. The interior contour of the walls of the openings 21 are preferably selected to grip the articles being packaged and prevent the articles from touching each other during storage or shipment.

Figure 2:
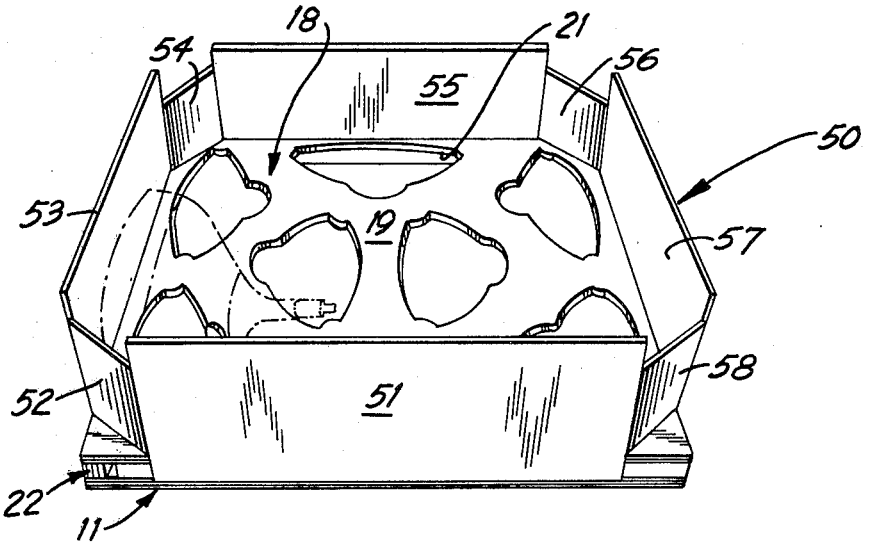
FIG. 2 is a perspective view of the bottom tray after assembly and showing an octagonal shaped sleeve.
Figure 3:
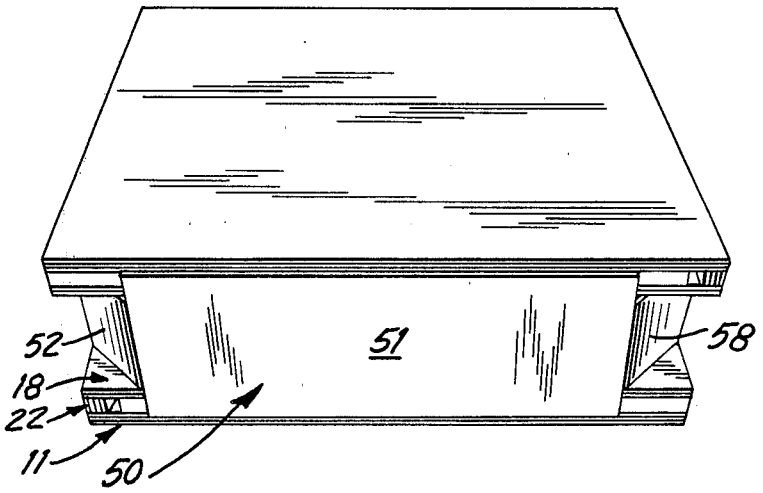
FIG. 3 is a perspective view showing the complete package of the present invention with the bottom tray, top tray and the sleeve separating the two trays.

The sleeve 50 is shown in FIGS. 2 and 3. The sleeve preferably is formed from an elongated die-cut panel of fiberboard, such as corrugated cardboard, and its various panels are connected by fold lines. It consists (in the sequence of its connected panel members and with reference to the orientation shown in FIG. 2) of a front panel 51, a first connecting panel 52, a first side panel 53, a second connecting panel 54, a rear panel 55, a third connecting panel 56, a second side panel 57, and a fourth connecting panel 58. The sleeve 50, seen from above, is of an octagon shape so that the side panels 53,57 are parallel, the front and rear panels 51,55 are parallel, and the connecting panels are parallel in pairs (panel 58 parallel to panel 54, panel 52 parallel to panel 56). The sleeve is completed by joining its free ends, for example, by adhering an overlapping panel (not shown) or by taping.

As shown in FIGS. 2 and 3, the smaller connecting end panels 52,54,56 and 57 are rectangular panels which are shorter in height than the larger side panels 51,53,55 and 57 so that they fit over the corners of the top and bottom pads. Preferably the height of the smaller end panels is such that the removed portions (at each of their vertical ends) equals, in height, the height (thickness) of a tray. In one alternative, slits may be formed in the corners of the pads for insertion of the end panels 52,54,56 and 58.

What is claimed is:

1. A fiberboard container for enclosing and protecting at least one article, said container comprising:

opposed top and bottom trays disposed in spaced parallel relationship, each said tray comprising rectangular base and article receiving pads defined by front, rear and opposed side edges, said pads being of substantially identical dimensions and being disposed in spaced parallel relationship such that the respective front, rear and side edges thereof are in register, said article receiving pads being further defined by at least one opening corresponding to the shape of the article, said trays being disposed such that the article receiving pads thereof face each other, and spacers extending between and connected to said pads in each said tray; and an octagonal sleeve extending between and separating said top and bottom trays, said sleeve including substantially rectangular front, rear and opposed side panels extending between the front, rear and opposed side edges respectively of the base pads, four substantially rectangular connecting panels extending between said article receiving pads and angularly aligned with respect to the front, rear and opposed side edges thereof, two said connecting panels foldably connecting said front panel to said side panels, and the remaining two connecting panels foldably connecting said rear panel to said side panels, whereby the front, rear and opposed side panels of said sleeve maintain said top and bottom trays in register while said connecting panels maintain a fixed spacing between said top and bottom trays, thereby enclosing and protecting the article.

2. A container as in claim 1 wherein the base pad of each said tray comprises a plurality of corrugated fiberboard panels adhesively laminated in face to face relationship.

3. A container as in claim 1 wherein the article receiving pad of each said tray comprises a plurality of corrugated fiberboard panels adhesively laminated into face to face relationship.

4. A container as in claim 1 wherein said spacers include wall spacers extending between and connecting the respective front, rear and opposed side edges of said base and article receiving pads in each said tray.

5. A container as in claim 4 wherein said spacers further include a plurality of internal spacers extending between and connecting said pads in each said tray and being disposed intermediate said wall spacers.

6. A container as in claim 5 wherein said wall and internal spacers each comprises a block formed from laminated layers of corrugated fiberboard material.

* * * * *